US006260203B1

(12) United States Patent
Battle

(10) Patent No.: US 6,260,203 B1
(45) Date of Patent: Jul. 17, 2001

(54) PROTECTIVE GLOVE FOR HAIR STYLISTS

(76) Inventor: LeArnetta Battle, 4969 Madison St., Gary, IN (US) 46408

( * ) Notice: Subject to any disclaimer, the term of this patent is extended or adjusted under 35 U.S.C. 154(b) by 0 days.

(21) Appl. No.: 09/566,144

(22) Filed: May 5, 2000

(51) Int. Cl.[7] ..... A41D 19/00
(52) U.S. Cl. ..... 2/161.6; 2/16; 2/163; 2/164
(58) Field of Search ..... 2/16, 20, 21, 159, 2/160, 161.1, 161.6, 162, 163, 164, 167, 169, 917; 132/73, 212

(56) References Cited

U.S. PATENT DOCUMENTS 3,928,871 * 12/1975 Wall ..... 2/161
4,025,962 * 5/1977 Hartung ..... 2/159
4,751,747 * 6/1988 Banks et al. ..... 2/21
5,575,008 * 11/1996 McBride et al. ..... 2/161.1
5,768,711 * 6/1998 Wissink ..... 2/161.1
6,026,513 * 2/2000 Sima ..... 2/163

* cited by examiner

*Primary Examiner*—John J. Calvert
*Assistant Examiner*—Katherine Moran
(74) *Attorney, Agent, or Firm*—Goldstein Law Offices P.C.

(57) ABSTRACT

A protective glove for hair stylists including a glove portion comprised of an open wrist portion for receiving a hand therein. The glove portion has a palm portion, a back portion, a thumb portion, an index finger portion, a middle finger portion, a ring finger portion, and a pinkie finger portion. The thumb portion, the middle finger portion, the ring finger portion, and the pinkie finger portion each have an open upper end whereby tips of these fingers of the hand are exposed. The glove portion includes an internal padded layer and an external fabric layer. The glove portion includes a thermal shield disposed over the external fabric layer.

4 Claims, 1 Drawing Sheet

PROTECTIVE GLOVE FOR HAIR STYLISTS

BACKGROUND OF THE INVENTION

The present invention relates to a protective glove for hair stylists and more particularly pertains to protecting a hair stylist's hands from being burned while using hot irons.

The use of protective gloves is known in the prior art. More specifically, protective gloves heretofore devised and utilized for the purpose of protecting the hands are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,751,747 to Banks discloses a finger and thumb heat protective device comprised of an insulated fabric with a cloth lining, for use by beauticians while using a heated hair iron. U.S. Pat. No. 5,363,508 to Kim discloses a finger and palm protector device comprised of two cylindrical members configured to fit over the user's middle and index fingers. U.S. Pat. No. 4,689,828 to Brewer discloses a hair stylist's device for protecting two fingers from being cut with scissors. U.S. Pat. No. 4,620,374 to Patterson discloses a hairstylist glove.

While these devices fulfill their respective, particular objective and requirements, the aforementioned patents do not describe a protective glove for hair stylists for protecting a hair stylist's hands from being burned while using hot irons.

In this respect, the protective glove for hair stylists according to the present invention substantially departs from the conventional concepts and designs of the prior art, and in doing so provides an apparatus primarily developed for the purpose of protecting a hair stylist's hands from being burned while using hot irons.

Therefore, it can be appreciated that there exists a continuing need for a new and improved protective glove for hair stylists which can be used for protecting a hair stylist's hands from being burned while using hot irons. In this regard, the present invention substantially fulfills this need.

SUMMARY OF THE INVENTION

In the view of the foregoing disadvantages inherent in the known types of protective gloves now present in the prior art, the present invention provides an improved protective glove for hair stylists. As such, the general purpose of the present invention, which will be described subsequently in greater detail, is to provide a new and improved protective glove for hair stylists which has all the advantages of the prior art and none of the disadvantages.

To attain this, the present invention essentially comprises a glove portion comprised of an open wrist portion for receiving a hand therein. The glove portion has a palm portion, a back portion, a thumb portion, an index finger portion, a middle finger portion, a ring finger portion, and a pinkie finger portion. The thumb portion, the middle finger portion, the ring finger portion, and the pinkie finger portion each have an open upper end whereby tips of these fingers of the hand are exposed. The glove portion includes an internal padded layer and an external fabric layer. The glove portion includes a thermal shield disposed over the external fabric layer. The thermal shield covers the palm portion, the index finger portion, and an interior of the middle finger portion. The open wrist portion includes a tightening strap with closure means for securing the glove portion of the hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective glove for hair stylists which has all the advantages of the prior art protective gloves and none of the disadvantages.

It is another object of the present invention to provide a new and improved protective glove for hair stylists which may be easily and efficiently manufactured and marketed.

It is a further object of the present invention to provide a new and improved protective glove for hair stylists which is of durable and reliable construction.

An even further object of the present invention is to provide a new and improved protective glove for hair stylists which is susceptible of a low cost of manufacture with regard to both materials and labor, and which accordingly is then susceptible of low prices of sale to the consuming public, thereby making such a protective glove for hair stylists economically available to the buying public.

Even still another object of the present invention is to provide a new and improved protective glove for hair stylists for protecting a hair stylist's hands from being burned while using hot irons.

Lastly, it is an object of the present invention to provide a new and improved protective glove for hair stylists including a glove portion comprised of an open wrist portion for receiving a hand therein. The glove portion has a palm portion, a back portion, a thumb portion, an index finger portion, a middle finger portion, a ring finger portion, and a pinkie finger portion. The thumb portion, the middle finger portion, the ring finger portion, and the pinkie finger portion each have an open upper end whereby tips of these fingers of the hand are exposed. The glove portion includes an internal padded layer and an external fabric layer. The glove portion includes a thermal shield disposed over the external fabric layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2:
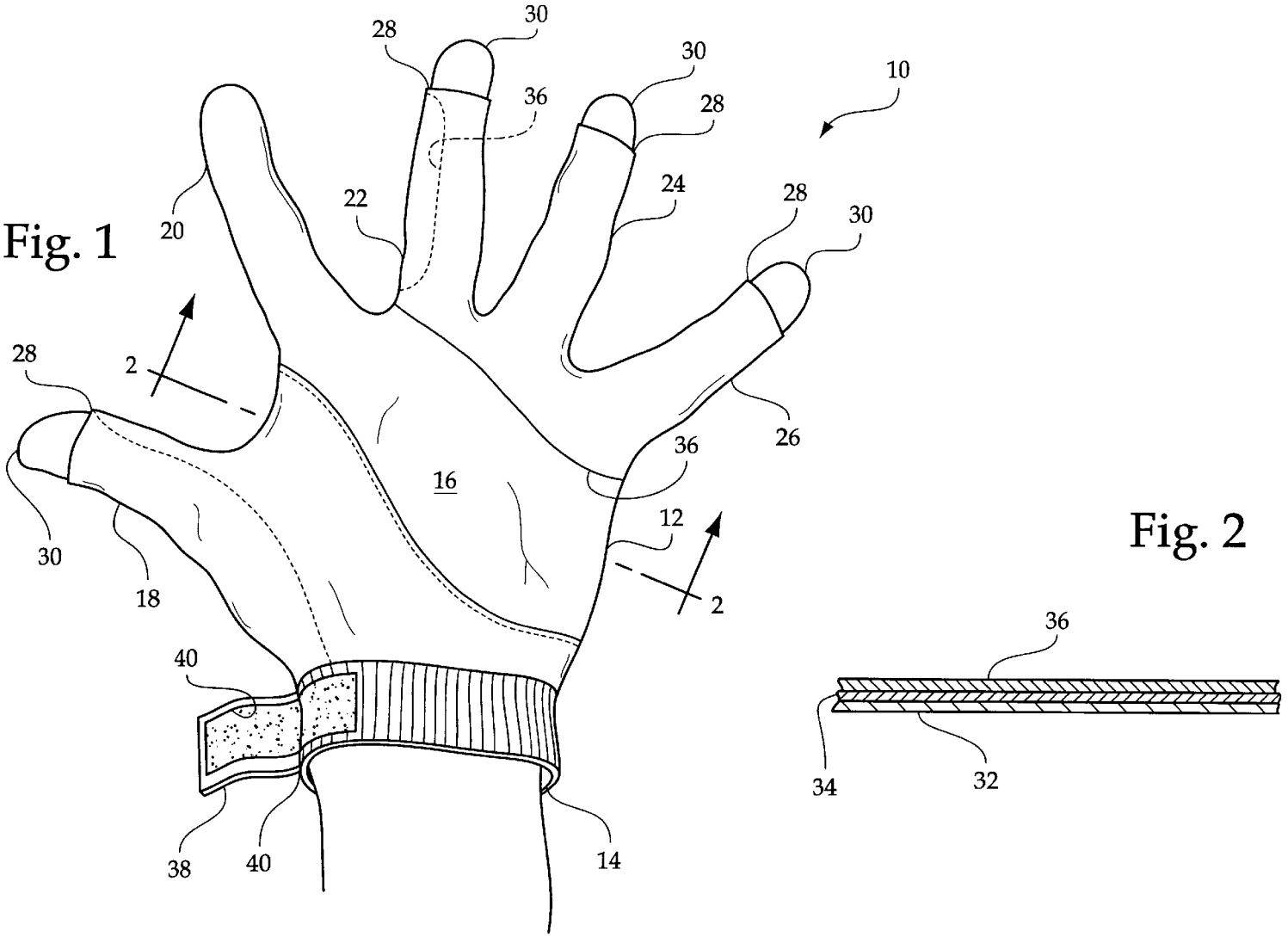
FIG. 1 is a perspective view of the preferred embodiment of the protective glove for hair stylists constructed in accordance with the principles of the present invention.
FIG. 2 is a cross-sectional view of the present invention as taken along line 2—2 of FIG. 1.

With reference now to the drawings, and in particular, to FIGS. 1 and 2 thereof, the preferred embodiment of the new and improved protective glove for hair stylists embodying the principles and concepts of the present invention and generally designated by the reference number 10 will be described.

Specifically, it will be noted in the various Figures that the device relates to a protective glove for hair stylists for protecting a hair stylist's hands from being burned while using hot irons.

The glove portion 12 is comprised of an open wrist portion 14 for receiving a hand therein. The glove portion 12 has a palm portion 16, a back portion, a thumb portion 18, an index finger portion 20, a middle finger portion 22, a ring finger portion 24, and a pinkie finger portion 26. The thumb portion 18, the middle finger portion 22, the ring finger portion 26, and the pinkie finger portion 26 each have an open upper end 28 whereby tips 30 of these fingers of the hand are exposed. This feature allows the user to freely operate these fingers in handling items. The glove portion 12 includes an internal padded layer 32 and an external fabric layer 34. These layers are preferably heat-resistant. The glove portion 12 includes a thermal shield 36 disposed over the external fabric layer 34. The thermal shield 36 covers the palm portion 16, the index finger portion 20, and an interior of the middle finger portion 22. The open wrist portion 14 includes a tightening strap 38 with closure means 40 for securing the glove portion 12 of the hand. The closure means, as illustrated in FIG. 1, is comprised of a pair of corresponding hook and loop patches. The open wrist band 14 can also be provided with support to protect the range of motion to prevent the onset of carpal tunnel syndrome. The glove portion 12 could also be provided with air holes for ventilation.

The present invention will protect hair stylists hands, fingers and wrists from burns and callouses that normally occur when handling hot irons.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective glove for hair stylists for protecting a hair stylist's hands from being burned while using hot irons comprising, in combination:

a glove portion comprised of an open wrist portion for receiving a hand therein, the glove portion having a palm portion, a back portion, a thumb portion, an index finger portion, a middle finger portion, a ring finger portion, and a pinkie finger portion, the thumb portion, the middle finger portion, the ring finger portion, and the pinkie finger portion each having an open upper end whereby tips of these fingers of the hand are exposed, the glove portion including an internal padded layer and an external fabric layer, the glove portion including a thermal shield disposed over the external fabric layer, the thermal shield covering the palm portion, the index finger portion, and an interior of the middle finger portion, the open wrist portion including a tightening strap with closure means for securing the glove portion of the hand.

2. A protective glove for hair stylists for protecting a hair stylist's hands from being burned while using hot irons comprising, in combination:

a glove portion comprised of an open wrist portion for receiving a hand therein, the glove portion having a palm portion, a back portion, a thumb portion, an index finger portion, a middle finger portion, a ring finger portion, and a pinkie finger portion, the thumb portion, the middle finger portion, the ring finger portion, and the pinkie finger portion each having an open upper end whereby tips of these fingers of the hand are exposed, the glove portion including an internal padded layer and an external fabric layer, the glove portion including a thermal shield disposed over the external fabric layer.

3. The protective glove for hair stylists as set forth in claim 2 wherein the thermal shield covers the palm portion, the index finger portion, and an interior of the middle finger portion.

4. The protective glove for hair stylists as set forth in claim 2 wherein the open wrist portion includes a tightening strap with closure means for securing the glove portion of the hand.

* * * * *